US006278215B1

(12) United States Patent
Latz

(10) Patent No.: US 6,278,215 B1
(45) Date of Patent: Aug. 21, 2001

(54) CARBON BRUSH WITH AT LEAST ONE PRESSED-IN STRANDED COPPER WIRE

(75) Inventor: Wilhelm Latz, Frankfurt (DE)

(73) Assignee: Deutsche Carbone AG, Frankfurt (DE)

( * ) Notice: Subject to any disclaimer, the term of this patent is extended or adjusted under 35 U.S.C. 154(b) by 0 days.

(21) Appl. No.: 09/505,669

(22) Filed: Feb. 17, 2000

(30) Foreign Application Priority Data

Feb. 22, 1999 (DE) ..... 299 03 230 U

(51) Int. Cl.[7] ..... H01R 39/26

(52) U.S. Cl. ..... 310/249; 310/248; 174/99 R; 174/126.1

(58) Field of Search ..... 310/249, 248, 310/251; 174/126.1, 128.1, 99 R

(56) References Cited

U.S. PATENT DOCUMENTS 294,148 * 2/1884 Pope ..... 174/128.1
1,523,599 * 1/1925 Lindblade ..... 310/249
1,629,875 * 5/1927 Kerlin et al. ..... 310/249
1,885,903 * 11/1932 Eynon ..... 310/249
2,451,839 * 10/1948 Lemon ..... 174/128.1
6,140,589 * 10/2000 Blackmore ..... 174/128.1

* cited by examiner

*Primary Examiner*—Burton S. Mullins
(74) *Attorney, Agent, or Firm*—Dennison, Scheiner, Schultz & Wakeman

(57) ABSTRACT

Carbon brush including at least one pressed-in stranded copper wire arranged as a plait-woven hollow stranded wire, formed from a plurality of copper strands of diameter 0.05 to 0.1 mm, and recrystallized by heat treatment. The hollow stranded wire contains at least one stiffening inner wire having a diameter of 0.1 to 0.5 mm, the diameter of the at least one stiffening inner wire being at least twice the diameter of any of the copper strands.

2 Claims, 1 Drawing Sheet

CARBON BRUSH WITH AT LEAST ONE PRESSED-IN STRANDED COPPER WIRE

BACKGROUND OF THE INVENTION

The invention is concerned with a carbon brush with at least one pressed-in stranded copper wire.

The stranded copper wires of such known carbon brushes are typically arranged as a plait-woven hollow stranded wire, and during their manufacture are subjected to heat treatment, namely sintering, whereby the temperature is typically from around 500° C. to 720° C. During this treatment, an almost complete recrystallisation of the copper takes place which results in an elastic, soft stranded copper wire. The latter properties of the stranded copper wire are desirable for their use in connection with carbon brushes in order for these to fulfil their function when installed in a motor, whereby any negative influence of the stranded copper wire on bringing the carbon brush into contact with a collector using static or dynamic spring pressure should be as small as possible.

In practise, however, the opposite requirement for stiffer stranded copper wire has arisen in part, particularly with respect to the manufacture of carbon brushes with pressed-in stranded copper wire and with the brush plates manufactured automatically from these. For the manufacture of the brush plates, the carbon brushes with pressed-in stranded copper wire are fed via an oscillating conveyor, whereby the individual carbon brushes circulate around a shaker several times. To avoid as far as possible any bending of the stranded copper wire and, as a result a failure of the brushes to be transported, or problems caused by the feed line to the carbon brush assembly area, a stiffer stranded copper wire is required.

SUMMARY OF THE INVENTION

This task is accomplished by means of a carbon brush containing a pressed-in stranded copper wire where the stranded copper wire has been recrystallized by a heat treatment, is formed from a plurality of copper strands, and contains at least one stiffening inner wire of diameter considerably greater that of any of the copper strands.

Surprisingly, it has been found that both for the operation of the carbon brushes with stranded copper wire and for their prior manufacture, a good compromise is achieved if the plait-woven hollow stranded wire made from stranded copper wires whose copper has been recrystallised by heat treatment and is therefore correspondingly soft is combined with an inner wire of considerably greater diameter than that of the individual wires making up the stranded copper wire, whereby the inner wire is comparatively stiff. The copper of the inner wire is also recrystallised. All in all, a targeted or defined stiffening the of copper wires combined in this way is achieved. The stiffness of these combined copper wires can be adjusted by a suitable combination of cross-sectional diameters of the stranded copper wire and the stiffening inner wire.

Advantageous for the manufacture is also the fact that the stranded copper wire, or the copper strands from which it is made, can be better aligned and need to be drawn only once.

In detail, as hitherto, hollow stranded wire of known dimensions made from copper strands each with a diameter of 0.05 to 0.1 mm can be advantageously combined with a stiffening single wire with a diameter of 0.1 to 0.5 mm. The diameter of the stiffening wire is thus at least twice that of the diameter of one of the copper wires making up the hollow stranded wire. On the whole, by selection of a suitable diameter of the stiffening inner wire, the stiffness of a stranded copper wire combined with this can be adjusted to meet the requirements for manufacture of the carbon brush or brush plate as well as the functional requirements for operation of such a carbon brush.

DESCRIPTION OF THE PREFERRED EMBODIMENT

Figure 1A:
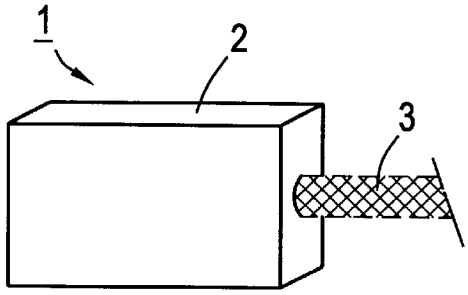
FIG. 1A PRIOR ART
FIG. 1 shows a carbon brush of the prior art, (A) in perspective view, (B) in a longitudinal cross-sectional view.
Figure 1B:
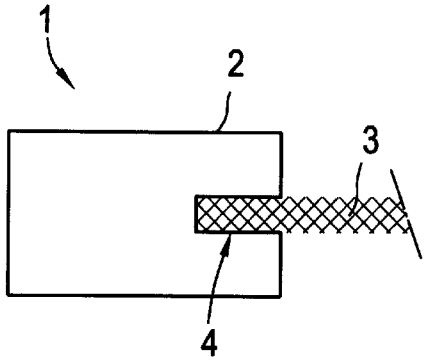
FIG. 1B PRIOR ART

As shown in FIG. 1, a carbon brush (1) of the prior art typically comprises a carbon body (2) and a stranded copper wire (3). The wire (3) is pressed in a blind hole (4) to provide electrical contact between the carbon body (2) and the wire (3).

Figure 2:
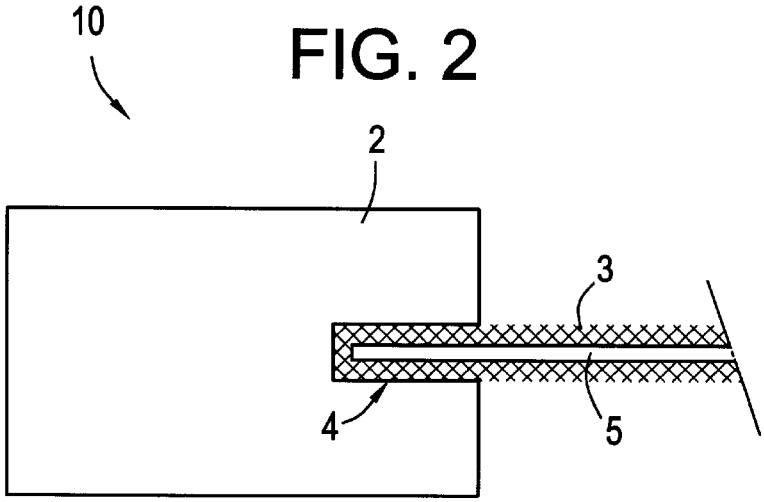
FIG. 2 shows a carbon brush of the invention in a longitudinal cross-sectional view.

As shown in FIG. 2, a carbon brush (10) according to the invention includes at least one pressed-in stranded copper wire (3) arranged as a plait-woven hollow stranded wire and made from stranded copper wire recrystallised by heat treatment which is correspondingly soft and the hollow stranded wire (3) contains at least one stiffening inner wire (5) of diameter considerably greater than that of one of the wires constituting the stranded wire (3). The (or each) stranded wire (3) is typically pressed together with said at least one stiffening wire (5) in a blind hole (4) to provide electrical contact between the carbon body (2) and the wire (3).

What is claimed is:

1. Carbon brush comprising at least one pressed-in stranded copper wire arranged as a plait-woven hollow stranded wire, formed from a plurality of copper strands of diameter 0.05 to 0.1 mm, and recrystallized by heat treatment, the hollow stranded wire containing at least one stiffening inner wire having a diameter of 0.1 to 0.5 mm, the diameter of the at least one stiffening inner wire being at least twice the diameter of any of the copper strands.

2. Carbon brush according to claim 1, wherein the hollow stranded wire containing the stiffening inner wire is pressed into a blind hole in a carbon body.

* * * * *